US012753357B1

(12) United States Patent
Hommeltoft

(10) Patent No.: US 12,753,357 B1
(45) Date of Patent: Oct. 6, 2026

(54) PROCESSING RENEWABLE LIPID FEEDSTOCKS COMPRISING FATTY ACID GLYCEROL ESTERS

(71) Applicant: CHEVRON U.S.A. INC., San Ramon, CA (US)

(72) Inventor: Sven Ivar Hommeltoft, Pleasant Hill, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 19/347,051

(22) Filed: Oct. 1, 2025

(51) Int. Cl.
*C10L 1/02* (2006.01)

(52) U.S. Cl.
CPC ..... *C10L 1/02* (2013.01); *C10L 2200/0476* (2013.01); *C10L 2290/543* (2013.01)

(58) Field of Classification Search
CPC ..... C10L 1/02; C10L 2200/0476; C10L 2290/543
See application file for complete search history.

(56) References Cited

U.S. PATENT DOCUMENTS

| | | | |
|---|---|---|---|
| 2,664,336 | A | 12/1953 | Cornell |
| 3,433,733 | A | 3/1969 | Bunn, Jr. et al. |
| 3,784,463 | A | 1/1974 | Reynolds et al. |
| 3,894,936 | A | 7/1975 | Hartley |
| 4,007,131 | A | 2/1977 | Gilespie |
| 4,645,585 | A | 2/1987 | White |
| 4,880,574 | A | 11/1989 | Welsh |
| 5,145,490 | A | 9/1992 | Sadowski |
| 6,187,465 | B1 | 2/2001 | Galloway |
| 7,998,339 | B2 | 8/2011 | Myllyoja et al. |
| 8,350,102 | B2 | 1/2013 | Roberts, IV et al. |
| 8,354,065 | B1 | 1/2013 | Sexton et al. |
| 9,580,657 | B2 | 2/2017 | Heydenrych et al. |
| 9,903,584 | B2 | 2/2018 | Fan et al. |
| 10,190,059 | B2 | 1/2019 | Chapus et al. |
| 10,479,943 | B1 | 11/2019 | Liu et al. |
| 10,947,458 | B1 | 3/2021 | Tengfei et al. |
| 11,479,725 | B2 | 10/2022 | Amblard et al. |
| 11,555,153 | B1 | 1/2023 | Hommeltoft |
| 11,912,947 | B1 | 2/2024 | Hommeltoft |

(Continued)

FOREIGN PATENT DOCUMENTS

| | | |
|---|---|---|
| CN | 101314748 | 12/2008 |
| CN | 102786966 | 11/2012 |

(Continued)

OTHER PUBLICATIONS

Gibon et al., "Palm oil refining," Eur. J. Lipid. Sci. Technol. 109 (2007), 315-335.

(Continued)

*Primary Examiner* — Cephia D Toomer
(74) *Attorney, Agent, or Firm* — Sheppard, Mullin, Richter & Hampton LLP; Jaime D. Choi

(57) ABSTRACT

Some examples provide a method for processing a renewable lipid feedstock comprising fatty acid glycerol esters. The method may include heating the renewable lipid feedstock, in the absence of a catalyst, to a temperature in the range of about 450° C. to about 550° C., using a heat flux greater than about 6000 BTU/ft$^2$/hour to generate a hot lipid stream substantially without forming coke.

22 Claims, 7 Drawing Sheets

(56) References Cited

U.S. PATENT DOCUMENTS

| | | | |
|---|---|---|---|
| 12,139,673 | B2 | 11/2024 | Andersson et al. |
| 12,319,878 | B2 | 6/2025 | Hommeltoft |
| 12,319,881 | B1 | 6/2025 | Han et al. |
| 12,421,460 | B2 | 9/2025 | Hommeltoft |
| 12,434,224 | B2 | 10/2025 | Hommeltoft |
| 12,582,954 | B1 | 3/2026 | Hommeltoft et al. |
| 12,590,255 | B1 | 3/2026 | Han et al. |
| 12,590,258 | B1 | 3/2026 | Hommeltoft et al. |
| 2008/0053870 | A1 | 3/2008 | Marker |
| 2009/0000185 | A1 | 1/2009 | Aulich et al. |
| 2009/0158637 | A1 | 6/2009 | McCall et al. |
| 2009/0300970 | A1 | 12/2009 | Perego |
| 2010/0043278 | A1 | 2/2010 | Brevoord |
| 2010/0163395 | A1 | 7/2010 | Henrich |
| 2011/0021857 | A1 | 1/2011 | Cao |
| 2011/0054230 | A1 | 3/2011 | Cole et al. |
| 2011/0056869 | A1 | 3/2011 | Novak et al. |
| 2011/0196113 | A1 | 8/2011 | Nesterenko |
| 2011/0237853 | A1 | 9/2011 | Hamamatsu et al. |
| 2012/0137572 | A1 | 6/2012 | Bartek et al. |
| 2012/0160741 | A1 | 6/2012 | Gong et al. |
| 2012/0203042 | A1 | 8/2012 | Huber et al. |
| 2012/0238787 | A1 | 9/2012 | Gruber et al. |
| 2012/0244585 | A1 | 9/2012 | Kale et al. |
| 2012/0251424 | A1 | 10/2012 | Havlik et al. |
| 2012/0258021 | A1 | 10/2012 | Badger |
| 2012/0316093 | A1 | 12/2012 | Zhan et al. |
| 2013/0006028 | A1 | 1/2013 | Chaogang et al. |
| 2013/0025187 | A1 | 1/2013 | Kocal et al. |
| 2013/0338409 | A1 | 12/2013 | Trewalla et al. |
| 2013/0338418 | A1 | 12/2013 | Xu |
| 2014/0012025 | A1 | 1/2014 | Sohling et al. |
| 2014/0109464 | A1 | 4/2014 | Powell et al. |
| 2014/0123973 | A1 | 5/2014 | North |
| 2014/0148609 | A1* | 5/2014 | Roussis ..... C10L 1/00 554/176 |
| 2014/0163285 | A1 | 6/2014 | Buchanan et al. |
| 2014/0171700 | A1 | 6/2014 | Roberts |
| 2015/0051428 | A1 | 2/2015 | Dayton |
| 2015/0087861 | A1 | 3/2015 | Devaux et al. |
| 2015/0141703 | A1 | 5/2015 | Dubois |
| 2015/0259202 | A1 | 9/2015 | Dybkj |
| 2017/0183581 | A1 | 6/2017 | Ladkat |
| 2018/0170824 | A1 | 6/2018 | Sreekumar |
| 2018/0258349 | A1 | 9/2018 | Heydenrych |
| 2019/0185759 | A1 | 6/2019 | Kanervo et al. |
| 2019/0299195 | A1 | 10/2019 | Nakazawa |
| 2020/0017772 | A1 | 1/2020 | Ramamurthy |
| 2021/0179952 | A1 | 6/2021 | Tsuto et al. |
| 2021/0380885 | A1 | 12/2021 | Mills |
| 2022/0041938 | A1 | 2/2022 | Hommeltoft |
| 2022/0048833 | A1 | 2/2022 | Drobyshev |
| 2022/0049172 | A1 | 2/2022 | Tiitta et al. |
| 2022/0119328 | A1 | 4/2022 | Schroer |
| 2022/0145199 | A1 | 5/2022 | Kuo |
| 2022/0403252 | A1 | 12/2022 | Vilja et al. |
| 2023/0098592 | A1 | 3/2023 | Novak |
| 2023/0234843 | A1 | 7/2023 | Hobby |
| 2023/0357106 | A1 | 11/2023 | Missalla et al. |
| 2024/0018419 | A1 | 1/2024 | Huizenga |
| 2024/0157320 | A1 | 5/2024 | Song et al. |
| 2024/0157347 | A1 | 5/2024 | Hommeltoft |
| 2024/0218261 | A1 | 7/2024 | Hommeltoft |
| 2024/0253028 | A1 | 8/2024 | Zhang |
| 2024/0425764 | A1 | 12/2024 | Hommeltoft |
| 2025/0027000 | A1 | 1/2025 | Hommeltoft |
| 2025/0333656 | A1 | 10/2025 | Hommeltoft |
| 2026/0008023 | A1 | 1/2026 | Hommeltoft |
| 2026/0015547 | A1 | 1/2026 | Hommeltoft |
| 2026/0027555 | A1 | 1/2026 | Hommeltoft |
| 2026/0092226 | A1 | 4/2026 | Hommeltoft |

FOREIGN PATENT DOCUMENTS

| | | | |
|---|---|---|---|
| EP | 2141217 | B1 | 3/2015 |
| EP | 4372069 | A1 | 5/2024 |
| FI | 20205954 | A1 | 3/2022 |
| FI | 20225933 | A1 | 4/2024 |
| FR | 2991596 | A1 | 12/2013 |
| WO | 2008/152199 | | 12/2008 |
| WO | 2009/130392 | | 10/2009 |
| WO | 2010071677 | | 6/2010 |
| WO | 2014/089131 | | 6/2014 |
| WO | 2015/148412 | | 10/2015 |
| WO | 2022221840 | | 10/2022 |
| WO | 2023/066738 | | 4/2023 |
| WO | 2023088772 | | 5/2023 |
| WO | 2024006239 | | 1/2024 |

OTHER PUBLICATIONS

Glowka et al., "Sustainable aviation fuel—Comprehensive study on highly selective isomerization route towards HEFA based bioadditives," Renewable Energy 220 (2024), 9 pages.

Huber et al., "Synthesis of Transportation Fuels from Biomass: Chemistry, Catalysts, and Engineering," Chem. Rev. (2006), 106, 4044-4098.

Mu et al., "Optimum design of radial flow moving-bed reactors based on a mathematical hydrodynamic model," Chemical Engineering and Processing 42 (2003), pp. 409-417.

Renz, "Ketonization of Carboxylic Acids by Decarbooxylation: Mechanism and Scope," Eur. J. Org. Chem. 2005, 979-988.

Shirzad et al., "Moving Bed Reactors: Challenges and Progress of Experimental and Theoretical Studies in a Century of Research," Ind. Eng. Chem. Res. 58 (2019), pp. 9179-9198.

Zabeti et al., "Biodiesel production using alumina-supported calcium-oxide: An optimization study," Fuel Processing Technology 91 (2010) 243-248.

Chen et al., "Catalytic fast pyrolysis of biomass: Selective deoxygenation to balance the quality and yield of bio-oil," Bioresource Technol., 273, pp. 153-158, 2019.

Chen et al., "Recent developments in ignocellulosic biomass catalytic fast pyrolysis: Strategies for the optimization of bio-oil quality and yield," Fuel Process Technol., 196, 106180, 2019.

Han et al., Advancing the application of bio-oils by co-processing with petroleum intermediates: A review, Energy Conversion and Management, 2021.

Liang et al., "Catalytic fast pyrolysis of lignocellulosic biomass: Critical role of zeolite catalysts," Renew. Sust. Energ. Rev., 139, 110707, 2021.

Thangadurai et al., "Acidity and basicity of metal oxide based catalysts in catalytic cracking of vegetable oil," Brazilian Journal of Chemical Engineering, 38:1-20, 2021.

Zhang et al., "Superheated steam as carrier gas and the sole heat source to enhance biomass torrefaction," Bioresource Technology, 2021.

Zhou et al., "Catalytic conversion of lignocellulosic biomass to fine chemicals and fuels," Chem. Soc. Rev. 40, pp. 5588-5617, 2011.

Li et al., "Applications of cvalcium oxide-based catalyst in biomass pyrolysis/gasification—A review," Journal of Cleaner Production, 291, pp. 1-12, 2021.

Mansir et al., "Catalytically active metal oxides studies for the conversion technology of carboxylic acids and bioresource based fatty acids to ketones: A review," Bioresource Technology Reports 17 (2022) 100988.

* cited by examiner

PROCESSING RENEWABLE LIPID FEEDSTOCKS COMPRISING FATTY ACID GLYCEROL ESTERS

FIELD

This application generally relates to renewable fuels.

BACKGROUND

There is an increasing interest in using lipid feedstocks, such as derived from plants, algae, animals, or microbiological organisms, to generate renewable fuels to replace or supplement fossil fuels. However, it may require several conventional steps to convert a lipid feedstock to a conventional renewable fuel, which may increase the time and expense of such conversion.

SUMMARY

Methods and systems for processing renewable lipid feedstocks comprising fatty acid glycerol esters are provided herein.

Some examples herein provide a method for processing a renewable lipid feedstock comprising fatty acid glycerol esters. The method may include heating the renewable lipid feedstock, in the absence of a catalyst, to a temperature in the range of about 450° C. to about 550° C., using a heat flux greater than about 6000 BTU/ft$^2$/hour to generate a hot lipid stream substantially without forming coke.

In some examples of the method, the heat flux is in the range of about 6000-25000 BTU/ft$^2$/hr. In some examples of the method, the heat flux is in the range of about 10000-20000 BTU/ft$^2$/hr.

In some examples of the method, the temperature is in the range of about 480° C. to about 550° C.

In some examples of the method, less than 40% of the hot lipid stream is lighter than T10 of the lipid feedstock.

In some examples of the method, less than 15% of olefins in the hot lipid stream are alpha olefins.

In some examples of the method, the heating is performed in the presence of steam or an inert gas.

In some examples of the method, the heating is performed in an unbranched single-tube heater.

In some examples of the method, the renewable lipid feedstock comprises at least about 5 ppm chlorine as an impurity.

In some examples of the method, the renewable lipid feedstock comprises choice white grease (CWG) or palm oil mill effluent (POME).

In some examples, the method further includes, in an adiabatic reactor, converting the hot lipid stream to an intermediate composition in the presence of a catalyst.

In some examples of the method, the intermediate composition is rich in ketones.

In some examples, the method further includes hydroprocessing the intermediate composition to form a final product.

In some examples of the method, the final product comprises a transportation fuel.

In some examples, the method further includes fractionating the intermediate composition to obtain a transportation fuel.

In some examples of the method, the catalyst comprises a metal oxide catalyst on an oxide support.

Some examples herein provide a system for processing a renewable lipid feedstock comprising fatty acid glycerol esters. The system may include a heater to generate a hot lipid stream, substantially without forming coke, by heating the renewable lipid feedstock, in the absence of a catalyst, to a temperature in the range of about 450° C. to about 550° C., using a heat flux greater than about 6000 BTU/ft$^2$/hour.

In some examples of the system, the heat flux is in the range of about 6000-25000 BTU/fta/hr. In some examples of the system, the heat flux is in the range of about 10000-20000 BTU/fta/hr.

In some examples of the system, the temperature is in the range of about 480° C. to about 550° C.

In some examples of the system, less than 40% of the hot lipid stream is lighter than T10 of the lipid feedstock.

In some examples of the system, less than 15% of olefins in the hot lipid stream are alpha olefins.

In some examples of the system, the heating is performed in the presence of steam or an inert gas.

In some examples of the system, the heater comprises an unbranched single-tube heater.

In some examples of the system, the renewable lipid feedstock comprises at least about 5 ppm chlorine as an impurity.

In some examples of the system, the renewable lipid feedstock comprises at least about 10 ppm phosphorous as an impurity.

In some examples of the system, the renewable lipid feedstock comprises choice white grease (CWG) or palm oil mill effluent (POME).

In some examples, the system further includes an adiabatic reactor to convert the hot lipid stream to an intermediate composition in the presence of a catalyst.

In some examples of the system, the intermediate composition is rich in ketones.

In some examples, the system further includes a hydroprocessing reactor to hydroprocess the intermediate composition to form a final product.

In some examples of the system, the final product comprises a transportation fuel.

In some examples, the system further includes a distillation column to fractionate the intermediate composition to obtain a transportation fuel.

In some examples of the system, the catalyst comprises a metal oxide catalyst on an oxide support.

DETAILED DESCRIPTION

Figure 1:
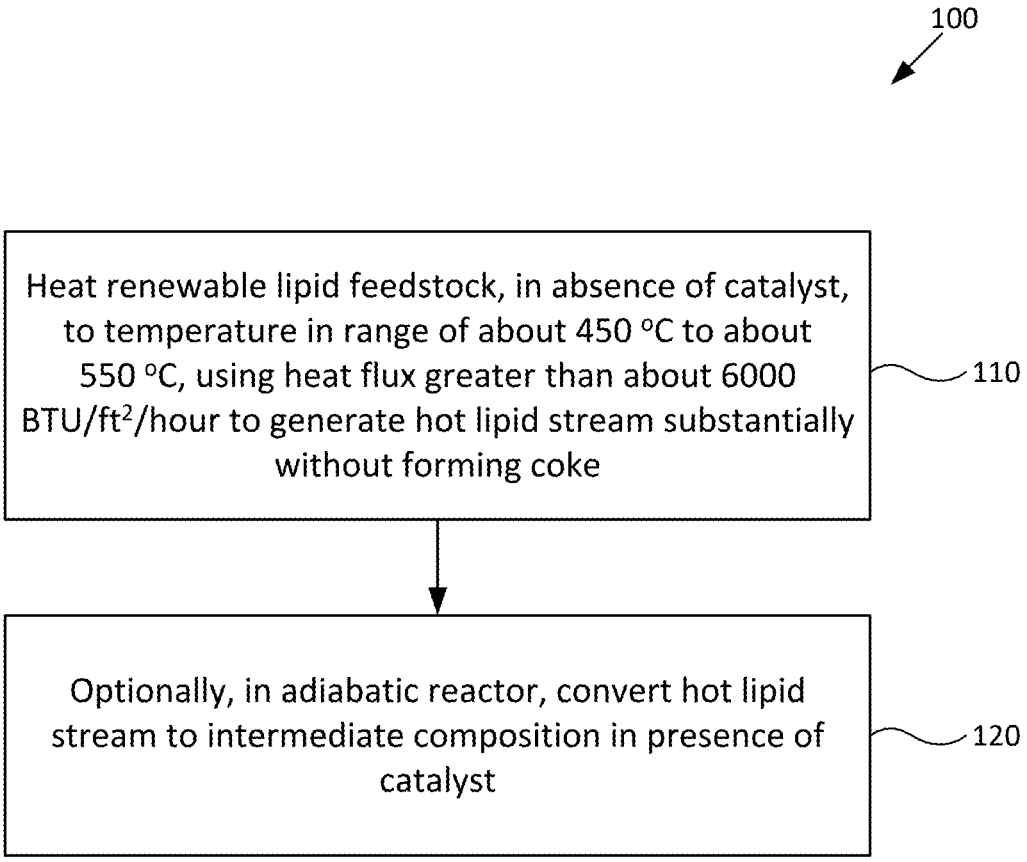
FIG. 1 illustrates an example flow of operations in a method for processing renewable lipid feedstocks comprising fatty acid glycerol esters.

A variety of renewable lipid feedstocks may be used to generate conventional renewable fuels, such as renewable diesel. However, conventional conversion techniques can be complicated and expensive, and may not be fully renewable. For example, fuels have been generated by transesterifying a lipid feedstock with light alcohol(s), such as methanol, to make a mixture of fatty acid methyl esters (FAME) known as biodiesel. ASTM standard D6751 defines biodiesel to be "fuel comprised of mono-alkyl esters of long chain fatty acids derived from vegetable oils or animal fats, designated B100." The conventional process for making biodiesel is well established, but the resulting product typically incorporates methanol made from natural gas rather than from a renewable resource, and may contain about 11 wt % oxygen.

As another example, fuels previously have been generated by directly hydroprocessing a lipid feedstock using a complex sequence of reaction steps including double bond saturation, hydro-deoxygenation, hydrocracking, and hydro-isomerization. In practice, such conversion process may use several reactors operating at high pressures (e.g., well in excess of 1000 psi hydrogen pressure). Additionally, because hydrogenation is highly exothermic, the rate at which such conversion process is performed may need to be severely restricted using recycle flow, thus limiting the conversion's overall throughput, e.g., by 50% or more. Still further, low Carbon Intensity (CI) lipid feedstocks may need to be extensively pretreated to remove impurities that either may passivate the hydroprocessing catalysts (e.g., metals or phosphorous) or that may challenge the metallurgy of the hydroprocessing units (e.g., chlorides), adding to the cost of production. Alternatively, a more pure, higher CI lipid feedstock may be used, which may reduce or avoid the need for pretreatment but nonetheless may add to the cost of production.

Such conventional hydroprocessing of lipid feedstocks may form a mixture of propane and distillate range hydrocarbons, where the latter are hydro-isomerized into renewable diesel. Conventional renewable diesel produced in this way is oxygen-free and contains carbon renewable resources. However, the hydroprocessing consumes substantial amounts of hydrogen which is typically produced from non-renewable resources. Additionally, the initially hydrogenated product is a wax, so conversion to a renewable diesel with acceptable cold flow properties requires extensive hydro-isomerization, adding to the cost of production.

These and other limitations of conventional, previously known methods of processing a lipid feedstock may limit throughput and increase cost and complexity, thus discouraging commercial implementation of renewable diesel and other renewable fuels. Additionally, these and other limitations of previously known methods of processing a lipid feedstock may use non-renewable resources, thus reducing any carbon savings from renewable diesel and other renewable fuels.

As provided herein, the present inventor has developed methods and systems for processing renewable lipid feedstocks that avoid the need to hydroprocess the lipid feedstock. More specifically, the present inventor has discovered that a renewable lipid feedstock including fatty acid glycerol esters may be heated, in the absence of a catalyst, to generate a hot lipid stream substantially without forming coke. Subsequently, metal oxide catalyst on an oxide support may be used to catalytically convert the hot lipid stream into an intermediate composition that may be used directly or indirectly as a fuel. As discovered by the present inventor, performing the heating step prior to the catalytic conversion may add sufficient heat to the hot lipid stream such that the catalytic conversion may be performed adiabatically. That is, the heat from heating the lipid stream may be used to perform the catalytic conversion without the need for additional heat to be added, and indeed can reduce the overall amount of energy required to convert the lipid feedstock to the intermediate composition, and thus the cost of production, as compared to the amount of energy that would be required to catalytically convert the lipid feedstock to the intermediate composition directly (that is, without the heating step). The present inventor has further discovered that although the heating step adds significant heat to the hot lipid stream, the fatty acid glycerol esters are not significantly chemically changed (e.g., are at most only partially cracked), and as such coke surprisingly is not substantially formed during the heating process.

First, some example terms will be explained. Then, non-limiting examples of the present methods and systems will be described.

Example Terms

As used herein, the term "about" is intended to mean within 10% of the stated value.

As used herein, the term "primarily" is intended to mean a majority, e.g., at least half. Illustratively, a composition which primarily has components with boiling point above a certain level, means that at least half of the composition is made up of components with boiling point about that level. The term "primarily" encompasses all ranges from at least a half to 100%, e.g., 51% or more, about 60% or more, about 70% or more, about 80% or more, about 90% or more, or about 95% or more, or about 98% of more, or about 99% or more, or about 100%.

As used herein, the term "substantially" is intended to mean significantly. Illustratively, a concentration of a component within a first composition which is substantially less than the concentration of that component within a second composition, means that the concentration of that component within the first composition is less than about 20% of the concentration within the second composition, e.g., less than about 10%, less than about 5%, less than 1%, or even less. As another example, a reaction that is performed using substantially only certain components means that of all the components which are present at the reaction, at least about 80%, at least about 90%, at least about 95%, at least about 98%, at least about 99%, or about 100% are the certain components.

As used herein, the term "lipid" is intended to refer to a fatty acid; glyceride (e.g., monoglyceride or diglyceride); glycerolipid (e.g., triglyceride, triacylglycerol, TAG, or neutral fat); phospholipid; or phosphoglyceride (also known as glycerophospholipid). Monoglycerides, diglycerides, and triglycerides may be referred to as fatty acid glycerol esters.

As used herein, the term "fatty acid" is intended to refer to a monocarboxylic acid having an aliphatic chain containing about 3 to 39 carbon atoms, illustratively about 7 to 23 carbon atoms. The aliphatic chain may be linear or branched, and may be saturated (e.g., may contain no carbon-carbon double bonds) or may be unsaturated (e.g., may contain one or more carbon-carbon double bonds).

As used herein, a "lipid feedstock" is intended to refer to a composition which is derived from a biological source, rather than from a fossil fuel source such as crude oil, shale oil, or coal, and primarily contains lipids. For example, a lipid feedstock may contain more than 50 wt % lipids, may contain more than 70 wt % lipids, may contain more than 85 wt % lipids, may contain more than 90 wt % lipids, may contain more than 95 wt % lipids, or more. A lipid feedstock may be derived from a plant, algae, animal, or microbiological organism. In some examples, a lipid feedstock may be derived from a low value waste material, side stream, by-product, residue, or sewage sludge. A lipid feedstock may be pretreated in a manner such as known in the art, for example, may be degummed, neutralized, bleached, and/or deodorized. Nonlimiting examples of renewable lipid feedstocks that are suitable for use in the present systems and methods include choice white grease (CWG), palm oil mill effluent (POME), algae oil, degummed soybean oil, or used cooking oil.

As used herein, "choice white grease" or "CWG" is intended to refer to inedible fat rendered from animals such as swine, cows, or sheep. According to the National Renderers Association, the specifications of CWG include a minimum TITER of 36.0° C., a maximum free fatty acid (FFA) content of 4, a maximum fat analysis committee (FAC) of 13-11B, no maximum value of R&B (refined and bleached), and a moisture, impurities, unsaponifiables (MIU) value of 1. For further details on these specifications and differences between CWG and other fats rendered from animals, see "Pocket Information Manual A Buyer's Guide to Rendered Products," Published by the National Renderers Association, Inc., Alexandria, Virginia, 44 pages (2003, edited for website in 2008), the entire contents of which are incorporated by reference herein.

As used herein, "palm oil mill effluent" or "POME" is intended to refer to the organic component of a waste product generated by extracting palm oil from palm fruits. The waste product contains water, unrecovered palm oil, free fatty acids, starches, proteins, and plant tissues. The palm oil extraction process generates the waste product in large volumes and, as recognized by the present inventor, it would be desirable to divert the waste product to beneficial uses such as renewable fuels. In some examples, the organic component of the waste product may be obtained by skimming the organic components off the top of the waste product, and/or by extracting it from the waste product (or from the skimmed organic components) using an organic solvent. For further details regarding the waste product and its previously known uses, see the following references, the entire contents of which are incorporated by reference herein: Okoli, "Oil Palm Tree Wastes 7: The composition and treatment of the palm oil mill effluent," Research Tropica (published online on Nov. 16, 2020 at URL researchtropica.com/oil-palm-tree-wastes-7-the-composition-and-treatment-of-the-palm-oil-mill-effluent/); and Okoli, "Oil Palm Tree Wastes 8: The uses of the palm oil mill effluent," Research Tropica (published online on Nov. 23, 2020 at URL researchtropica.com/oil-palm-tree-wastes-8-the-uses-of-the-palm-oil-mill-effluent/).

Depending on the source and the pretreatment (if any), a lipid feedstock may contain a mixture of different lipids. Illustratively, a lipid feedstock may include about 0-90 weight percent (wt %) of free fatty acids, about 5-100 wt % of fatty acid glycerol esters (e.g., monoglycerides, diglycerides, and/or triglycerides), and about 0-20 wt % of one or more compounds selected from the group consisting of: fatty acid esters of the non-glycerol type, fatty amides, and fatty alcohols. In some examples, the lipid feedstock may include more than about 50 wt % of free fatty acids and fatty acid glycerol esters, e.g., more than about 70 wt % of free fatty acids and fatty acid glycerol esters, or more than about 80 wt % of free fatty acids and fatty acid glycerol esters. The concentration of free fatty acids in a lipid feedstock may be characterized by determining the total acid number (TAN) of the feedstock, by measuring the mass of potassium hydroxide (KOH) in milligrams that is required to neutralize one gram of the lipid feedstock; see also ASTM D664. In some examples, a lipid feedstock may have a TAN of at least about 5 mg KOH/g, e.g., about 5-150 mg KOH/g, or about 10-150 mg KOH/g, or about 10-100 mg KOH/g, or about 10-50 mg KOH/g, or about 10-25 mg KOH/g, or about 10-20 mg KOH/g. A lipid feedstock may contain one or more impurities, such as phosphorous, silicon, chloride, an alkali metal such as sodium or potassium, an alkaline earth metal such as magnesium or calcium, a metal such as manganese or iron, or the like.

As used herein, the term "hot lipid stream" is intended to refer to a product that is produced by heating a lipid feedstock including fatty acid glycerol esters at a sufficiently low temperature, sufficiently rapidly such that the fatty acid glycerol esters do not fully crack (that is, at most only partially crack). For example, less than 40% of the hot lipid stream may be lighter than T10 of the lipid feedstock, where T10 refers to the boiling point of the heaviest part of the lightest 10% (by volume), meaning that no more than 40% of the front end distillation of the hot lipid stream would boil at the T10 value of the feed, representing only partial cracking. Additionally, or alternatively, for example, less than 15% of olefins in the hot lipid stream are alpha olefins. For example, composition varies to different extents due to thermal cracking as a function of temperature, and residence time. The 15% appears to be in line with FIG. 6 (described below) where higher flux operation allows for alpha olefin content to stay below 15%. Accordingly, any change in composition of the lipid stream being heated in the heater is limited, while still achieving a fixed target heater outlet temperature.

As used herein, the term "intermediate composition" is intended to refer to a product that is produced, directly or indirectly, from a lipid feedstock using a thermocatalytic process, and that may be used directly as a renewable fuel or may be further processed (e.g., hydroprocessed) to generate an at least partially renewable fuel. In some examples, the intermediate compositions provided herein may include less than about 70 wt % of an amount of oxygen in the lipid feedstock. An intermediate composition may include oxygenated hydrocarbons such as carboxylic acids, alcohols, ketones, aldehydes, and the like. In some examples, about 10 wt % to 50 wt % of the molecules of a liquid portion of the intermediate composition includes oxygen, and about 50 wt % or more of the molecules of the liquid portion of the intermediate composition do not include oxygen. In some examples, the intermediate composition is rich in ketones. Illustratively, at least about 70 wt %, or at least about 80 wt %, of the oxygen in the liquid portion of the intermediate composition may be within ketone groups. An intermediate composition may include gaseous and liquid components.

As used herein, the term "pyrolysis" is intended to refer to the thermal decomposition of organic materials in an oxygen-lean atmosphere (that is, an atmosphere containing significantly less oxygen than required for complete combustion).

As used herein, the term "hydroprocessing" is intended to refer to a process in which a composition is reacted with hydrogen in the presence of a catalyst under suitable conditions, e.g., elevated temperature and/or elevated pressure. Nonlimiting examples of hydroprocessing include hydrogenation, double bond saturation, hydrodeoxygenation, hydrocracking, hydro-isomerization, hydrodesulfurization, hydrodenitrogenation, hydrodearomatization, hydrodewaxing, and mild hydrocracking.

As used herein, the term "transportation fuel" refers to a fraction, cut, or blend of hydrocarbons having a distillation curve which is standardized for use in the transportation industry. For example, diesel fuel corresponds to a middle distillate from 160° C. to 380° C. (according to EN 590). Gasoline and naphtha are other standardized, well-characterized forms of transportation fuels. For example, naphtha has a boiling point of about 20° C. to about 100-150° C. When a transportation fuel is derived from a lipid feedstock (e.g., via a hot lipid stream and an intermediate composition in a manner such as provided herein), then the transportation fuel may be referred to herein as a "renewable fuel." When a fuel (such as a transportation fuel, e.g., renewable fuel) is ready for use without substantial further processing, it may be referred to as a "final product." The final product may be conveyed to a site of use in any suitable manner, e.g., by pipeline, truck, and/or rail.

As used herein, the term "ppm" is intended to refer to parts-per-million and is a weight-relative parameter. A ppm is a microgram per gram, such that a component that is present at 10 ppm in a composition is present at 10 micrograms of the component per 1 gram of the composition.

Processing Renewable Lipid Feedstocks Including Fatty Acid Glycerol Esters

As noted further above, conventional, previously known methods of processing lipid feedstocks into fuel may be complex, time consuming, and costly, and may use non-renewable resources. The present inventor has discovered that the present systems and methods may be used to efficiently and cost-effectively convert lipid feedstocks into intermediate compositions suitable for use directly or indirectly as renewable fuels.

FIG. 1 illustrates an example flow of operations in a method 100 for processing renewable lipid feedstocks comprising fatty acid glycerol esters. Method 100 for processing renewable lipid feedstocks generates a hot lipid stream substantially without forming coke and thus limits reactor fouling. Any suitable renewable lipid feedstock may be used. In particular, it has surprisingly been found that the present methods and systems are compatible with lipid feedstocks with sufficiently high levels of impurities that such feedstocks may poison the catalysts used in other types of processing, or may require significant pre-processing to remove the impurities. Indeed, certain renewable feedstocks contain a concentration of contaminants which is sufficiently high as to hinder use of that feedstock to generate renewable fuel. In particular, it has been believed that high-phosphorous lipid feedstocks (that is, lipid feedstocks having more than about 10 ppm of phosphorous) may poison hydroprocessing catalysts that otherwise may be used to convert low-phosphorous lipid feedstocks (that is, feedstocks having less than about 10 ppm of phosphorous, or less than about 1 ppm of phosphorous) into renewable fuel. Certain catalysts have previously been developed to remove phosphorous from renewable feedstocks, such as TK-3000 PhosTrap™ (Topsoe A/S), which purports to absorb phosphorous and thus protect against pressure-drop buildup and activity loss that the phosphorous may otherwise cause. However, such catalysts may increase the cost and complexity of converting a renewable feedstock. For example, the phosphorous removal catalyst may be disposed in a guard bed, and the feedstock contacted with such catalyst to reduce phosphorous before the feedstock is further processed using another catalyst.

In comparison, the present systems and methods are compatible with lipid feedstocks with relatively high levels of impurities, e.g., at least about 5 ppm chlorine as an impurity and/or may include at least about 10 ppm phosphorous as an impurity. Such impurity level(s) may occur in renewable lipid feedstocks such as choice white grease (CWG) or palm oil mill effluent (POME), algae oil, degummed soybean oil, or used cooking oil, which otherwise may be difficult or costly to process. The processing steps provided herein do not require the use of a separate catalyst (or other processing) to remove impurities from the feedstock, reducing the cost and complexity of converting the renewable feedstock into an intermediate composition. Moreover, the intermediate composition may have a substantially lower impurity content than the lipid feedstock, and accordingly may be processed with reduced risk of poisoning any catalyst(s) which are subsequently used to convert the intermediate composition into a renewable fuel, thus reducing the cost and complexity of converting the intermediate composition into the renewable fuel.

Additionally, as recognized by the present inventor, heating the lipid feedstock to only partially crack the lipid feedstock, using catalyst-free heating, provides significant and surprising benefits to the amount of energy needed to subsequently catalytically process the feedstock to form the intermediate composition. For example, heating the lipid feedstock may be used to change the energy balance over the catalytic reactor which is subsequently used, and indeed may allow the catalytic reactor to be operated without the need to inject additional heat to drive the catalytic reactions. That is, the catalytic reactor may be run adiabatically, such that only the chemical and thermal energy from the hot lipid stream and other feeds into the catalytic reactor are used to drive the reactions which convert the hot lipid stream into the intermediate composition.

Illustratively, in the nonlimiting example illustrated in FIG. 1, method 100 includes heating the renewable lipid feedstock, in the absence of a catalyst, to a temperature in the range of about 450° C. to about 550° C., using a heat flux greater than about 6000 BTU/ft$^2$/hour to generate a hot lipid stream substantially without forming coke (operation 110). Illustratively, the heat flux may be in the range of about 6000-25000 BTU/ft$^2$/hr, for example in the range of about 10000-20000 BTU/ft$^2$/hr. Such heating further may at most only partially crack the fatty acid glycerol esters (e.g., to form products such as one or more of free fatty acids, cyclization products, olefins, acrolein, and alkanes). Illustratively, less than 40% of the hot lipid stream is lighter than T10 of the lipid feedstock. Additionally, or alternatively, less than 15% of olefins in the hot lipid stream are alpha olefins. Operation 110 may be performed using a heater, e.g., in a manner such as described further below with reference to FIGS. 2 and 3A-3B. Optionally, the heating may be performed in the presence of steam or an inert gas.

The present inventor has found that heating the renewable lipid feedstock to the temperature range of about 450° C. to about 550° C. (and optionally to the narrower temperature range of about 480° C. to about 550° C.), at a relatively high heat flux (e.g., greater than about 6000 BTU/ft$^2$/hour), for a sufficiently short period of time surprisingly reduces cracking of fatty acid glycerol esters as compared to conditions of lower heat flux. This may seem counterintuitive because the higher heat flux means a higher wall temperature in the heater, but tests comparing lipid heating to the same temperature, such as described below in the working examples, clearly show that higher heat flux lowers the extent of cracking and isomerization. The present inventor further has found that heating the renewable lipid feedstock to the temperature range of about 450° C. to about 550° C. (and optionally to the narrower temperature range of about 480° C. to about 550° C.), at a relatively high heat flux (e.g., greater than about 6000 BTU/ft$^2$/hour) for a sufficiently short period of time surprisingly deposits relatively low amounts of coke in the heater, even when using lipid feedstocks with high levels of impurities (e.g., at least about 5 ppm chlorine as an impurity and/or may include at least about 10 ppm phosphorous as an impurity.

Method 100 illustrated in FIG. 1 optionally further may include, in an adiabatic reactor, converting the hot lipid stream to an intermediate composition in the presence of a catalyst (operation 120). For example, method 100 illustrated in FIG. 1 optionally further may include feeding the hot lipid stream to an adiabatic reactor, for example using suitable piping connecting the heater to the adiabatic reactor such as described further below with reference to FIGS. 2 and 3A-3B. In some examples, the piping is configured to maintain at least a portion of the heat which operation 110 adds to the hot lipid stream, so that such heat then is added to the adiabatic reactor in a manner such as now will be described. In some examples, the catalyst in the adiabatic reactor may be or include a metal oxide catalyst on an oxide support. In some examples, the metal oxide catalyst includes at least one metal selected from the group consisting of Na, K, Mg, Ca, Sr, and a rare earth metal. Illustratively, the metal oxide catalyst may include at least one metal selected from the group consisting of Na, K, Ca, and Mg. In some examples, the metal of the metal oxide catalyst may be an alkali metal such as lithium, sodium, or potassium. In some examples, the metal of the metal oxide catalyst may be an alkaline earth metal such as magnesium, strontium, or calcium.

In one nonlimiting example, the metal oxide catalyst may include calcium oxide, and in some examples may consist essentially of calcium oxide, or may consist of calcium oxide. The calcium within the calcium oxide catalyst may be in oxidation state 2 (as in CaO), but it may be in any suitable chemical form and is not limited to exclusively CaO. Additionally, the chemistry of the calcium oxide catalyst may change over time and/or with exposure to the hot lipid stream. For example, the calcium oxide catalyst initially may be in the form of CaO, CaO(OH), or $Ca(OH)_2$, or a mixture thereof. In operation, the calcium may be in the form of a mixture of any such compounds and/or in the form of carbonate or carboxylate. Additionally, or alternatively, the calcium may become partially embedded in the oxide support as aluminate, e.g., oxy-aluminate and/or hydroxy-aluminates. The metal oxide catalyst may be supported on any suitable oxide support, such as alumina. In some examples, the hot lipid stream is flowed over substantially no other solid-state materials besides the metal oxide catalyst (e.g., calcium oxide catalyst or other alkaline earth metal oxide catalyst) on the oxide support (e.g., alumina). The hot lipid stream may be flowed over the metal oxide catalyst in any suitable adiabatic reactor(s). Although the oxide support may not specifically be mentioned in all cases, it will be understood that the metal oxide catalyst is supported by the oxide support.

The metal oxide catalyst on the oxide support additionally, or alternatively, may have any suitable combination of properties, e.g., bulk density, particle density, packed density, pore volume, large pore content, average pore diameter, and/or surface area. Illustratively, the metal oxide catalyst may have one or more of the following properties, or any suitable combination of two or more of the following properties: a bulk density in the range of about 0.78 kg/l to about 0.86 kg/l; a particle density in the range of about 1.2 kg/l to about 1.4 kg/l; a packed density in the range of about 0.8 g/cc to about 1.0 g/cc; a pore volume in the range of about 0.42 to about 0.48 cc/g; a large pore content (pores>1000 Å) of about 0.30 cc/g to about 0.38 cc/g; an average pore diameter (D50) of about 100 Å to about 200 Å; and/or a surface area of about 50 m$^2$/g to about 150 m$^2$/g. Additionally, or alternatively, the metal oxide catalyst may have one or more of the following properties, or any suitable combination of two or more of the following properties: a bulk density in the range of about 0.80 kg/l to about 0.84 kg/l; a particle density in the range of about 1.1 kg/l to about 1.3 kg/l; a packed density in the range of about 0.85 g/cc to about 0.95 g/cc; a pore volume in the range of about 0.44 to about 0.46 cc/g; a large pore content (pores>1000 Å) of about 0.33 cc/g to about 0.36 cc/g; an average pore diameter (D50) of about 130 Å to about 160 Å; and/or a surface area of about 80 m$^2$/g to about 120 m$^2$/g.

Referring again to FIG. 1, the metal oxide catalyst in the adiabatic reactor may catalytically convert the hot lipid stream into an intermediate composition which is rich in ketones, e.g., having at least 70% of its oxygen within ketone groups. The hot lipid stream may be reacted with the metal oxide catalyst under any suitable combination of reaction conditions to generate the intermediate composition. In various examples, the catalytic conversion may be performed at a temperature of about 400° C. to about 700° C., illustratively about 425° C. to about 600° C., e.g., about 450° C. to about 550° C., e.g., about 475° C. to about 500° C. Additionally, in some examples, the catalytic conversion may be performed at a pressure in the range of about 0.01 MPa to about 10 MPa, illustratively about 0.1 to about 5 MPa, e.g., about 0.1 to about 1 Mpa. Additionally, in some examples, the catalytic conversion may be performed at a liquid hourly space velocity (LHSV) in the range of about 0.1 h$^{-1}$ to about 10 h$^{-1}$, illustratively about 0.2 h$^{-1}$ to about 5 h$^{-1}$, or about 0.3 h$^{-1}$ to about 3 h$^{-1}$, or about 0.5 h$^{-1}$ to about 1.5 h$^{-1}$. LHSV may be calculated as the volume of hot lipid stream per volume of catalyst per hour.

The reaction(s) performed using the metal oxide catalyst may reduce the amount of oxygen in the hot lipid stream relative to that which was present in the lipid feedstock, and relative to that which was present in the hot lipid stream. For example, the hot lipid stream may be partially cracked in the heater, but the bulk of oxygen removal takes place across the catalytic reactor. In some examples, the intermediate composition may include less than about 70 wt % of an amount of oxygen in the lipid feedstock. Additionally, the reaction(s) performed using the metal oxide catalyst may modify the location(s) of oxygen within the molecules being reacted. For example, at least about 70 wt %, or at least about 80 wt % of the oxygen in the liquid portion of the intermediate composition may be within ketone groups. In comparison, in some examples, the lipid feedstock and the hot lipid stream substantially may not include any ketone groups.

As provided herein, in addition to converting the hot lipid stream to the intermediate composition, the metal oxide catalyst on the oxide support also may be used to remove impurities from the hot lipid stream during operation 120, for example without the use of a separate catalyst. Indeed, the catalytic conversion during operation 120 may remove multiple contaminants. In some examples, the intermediate composition lacks a detectable amount of metal. In some examples, the intermediate composition lacks a detectable amount of phosphorous. In some examples, intermediate composition lacks a detectable amount of chlorine. The amount (if any) of metal, phosphorous, and/or certain other contaminants may be measured in any suitable manner, such as inductively coupled plasma-mass spectrometry (ICP). In some examples, an organic chloride contaminant level can be determined by X-ray Fluorescence Spectroscopy, e.g., ASTM D7536-09, Standard Test Method for Chlorine in Aromatics by Monochromatic Wavelength Dispersive X-ray Fluorescence Spectrometry. In other examples, chlorine content may be determined using combustion ion chromatography (CIC), a technique in which a sample is burned in an oxygen-containing gas flow, the gas generated (including halogen ions) is absorbed by a solution, and then the halogen content of the solution is quantitatively analyzed using ion chromatography. Additionally, or alternatively, in some examples, chlorine content may be determined using X-ray fluorescence to determine chloride content with a detection limit of about 1 ppm.

When it is described herein that a composition "lacks a detectable amount" of an element, it means that the amount of that element in the composition is approximately at or below than the measurement threshold of the respective instrument being used to measure that element. Of course, different instruments may have different measurement thresholds than one another. In some examples, the instrument has a measurement threshold of about 5 ppm, and the intermediate composition has a concentration of less than about 5 ppm of metal, phosphorous, and/or chlorine. In some examples, the instrument has a measurement threshold of about 1 ppm, and the intermediate composition has a concentration of less than about 1 ppm of metal, phosphorous, and/or chlorine. In other examples, the instrument has a measurement threshold of about 0.5 ppm, and the intermediate composition has a concentration of less than about 0.5 ppm of metal, phosphorous, and/or chlorine. In still other examples, the instrument has a measurement threshold of about 0.1 ppm, and the intermediate composition has a concentration of less than about 0.1 ppm of metal, phosphorous, and/or chlorine.

The intermediate composition formed using operations 110-120 may be rich in distillate range hydrocarbons. For example, at least about 30 wt. %, or at least 50% of components, or more, of the intermediate composition may have boiling points between about 150° C. and about 350° C. In some examples, the intermediate composition is substantially free of free fatty acids. For example, the intermediate composition may have a total acid number (TAN) less than about 5 mg KOH/g, or even a TAN less than about 3 mg KOH/g. The intermediate composition may include gaseous and liquid components. It will be appreciated that the intermediate composition may be used for any suitable purpose. For example, the intermediate composition may include a transportation fuel, and optionally may be fractionated to obtain the transportation fuel.

Figure 2:
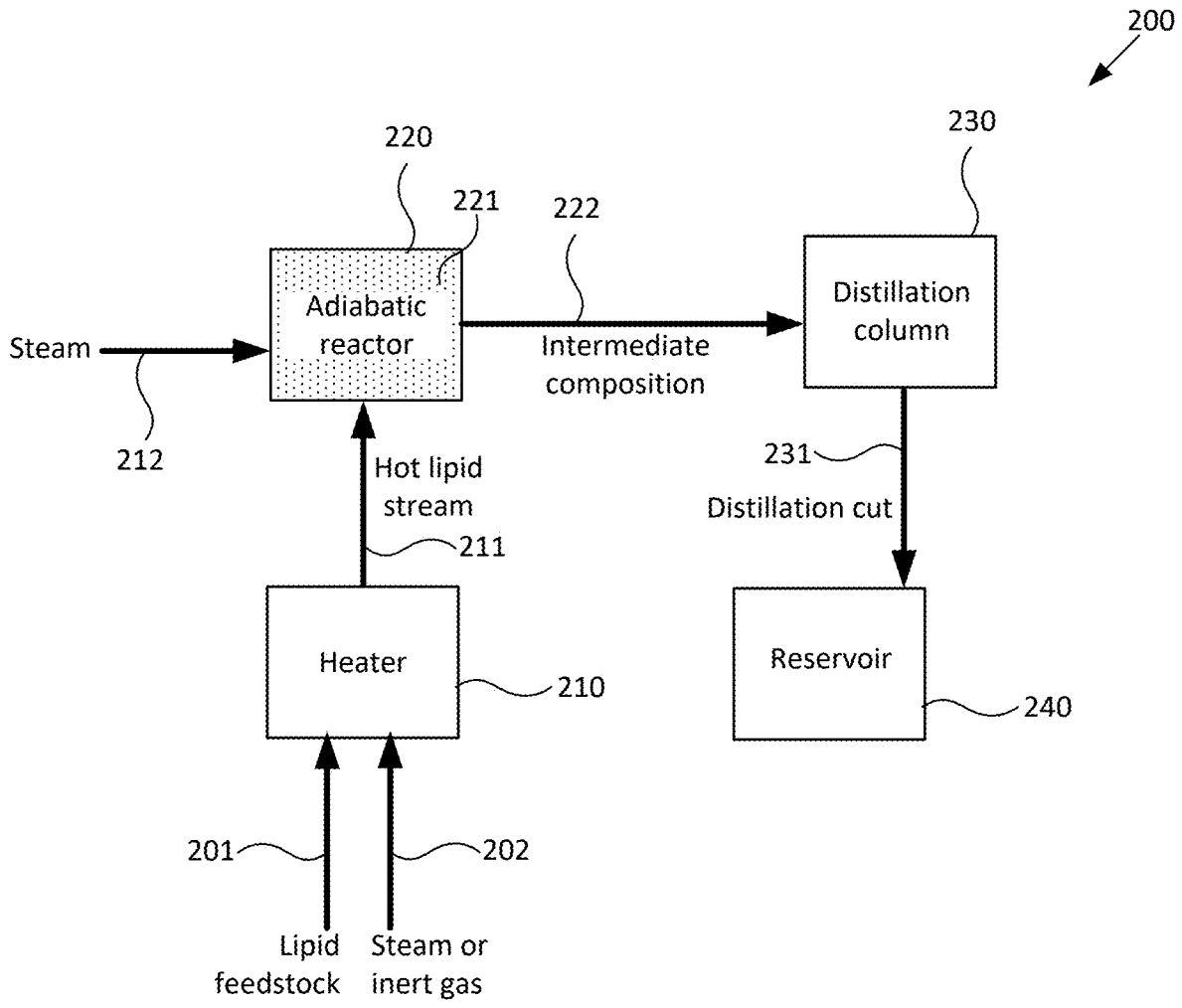
FIG. 2 schematically illustrates an example system for processing renewable lipid feedstocks comprising fatty acid glycerol esters.

It will further be appreciated that any suitable system may be used to perform the operations of method 100. For example, FIG. 2 schematically illustrates an example system 200 for processing a renewable lipid feedstock including fatty acid glycerol esters. Illustratively, the renewable lipid feedstock may include choice white grease (CWG) or palm oil mill effluent (POME), although a wide variety of other lipid feedstocks may be used. System 200 includes heater 210, adiabatic reactor 220, distillation column 230, and reservoir 240. In this example, heater 210 is coupled to adiabatic reactor 220 via piping 211, adiabatic reactor 220 is coupled to distillation column 230 via piping 222, and distillation column 230 is coupled to reservoir 240 via piping 231. Other configurations suitably may be used.

Heater 210 may be configured to perform operation 110, that is, to heat the renewable lipid feedstock, in the absence of a catalyst, to a temperature in the range of about 450° C. to about 550° C., using a heat flux greater than about 6000 BTU/ft$^2$/hour to generate a hot lipid stream substantially without forming coke. For example, heater 210 may be coupled to piping 201 via which the heater receives a lipid feedstock such as described elsewhere herein. Optionally, heater 210 is configured to heat the renewable lipid feedstock in the presence of steam or an inert gas. For example, heater 210 may be coupled to piping 202 via which steam or an inert gas is introduced to heater 210 for use in generating the hot lipid stream. In some examples, the steam or inert gas may increase the velocity in the heater to reduce the fouling potential. In some examples, the steam is mixed with the hot lipid stream and delivered to reactor 220 through piping 211, allowing simultaneous heating of both the feed and the steam in a single unit operation. In some examples, operation 200 may utilize both piping 212 and piping 202 to deliver steam to reactor 220 and heater 210, respectively.

Piping 211 may be configured to transport the hot lipid stream from the heater 210 to the adiabatic reactor 220. Adiabatic reactor 220 may be configured to convert the hot lipid stream to an intermediate composition in the presence of a catalyst. For example, as illustrated in FIG. 2, metal oxide catalyst 221 may be disposed. Piping 211 may be coupled to a first inlet of adiabatic reactor 220 such that the hot lipid stream may be flowed into adiabatic reactor 220 and across metal oxide catalyst 221. Piping 212 may be coupled to a second inlet of adiabatic reactor 220 such that steam may be flowed into adiabatic reactor 220 and across metal oxide catalyst 221 together with the hot lipid stream.

In some examples, the metal oxide catalyst 221 is in a fixed bed over which the hot lipid stream is flowed, the metal oxide catalyst and the hot lipid stream may be brought into contact with one another in any suitable manner. In other examples, the metal oxide catalyst 221 instead may be in a fluid bed, or in a moving bed. In some examples, the metal oxide catalyst 221 may be in a fluid bed. In some examples, the fluid bed is directly heated. In some examples, the catalyst may be heated instead of, or in addition to, heating the feed. It will be appreciated that the metal oxide catalyst on the oxide support may have any suitable configuration for use in the particular adiabatic reactor 220. In some examples, the metal oxide catalyst on the oxide support includes particles with sizes in the range of about 0.01 mm to about 5 mm. In nonlimiting examples in which a fixed bed reaction is used, the metal oxide catalyst on the oxide support may include (or in some cases may consist essentially of) particles with sizes in the range of about 1 mm to about 5 mm. In nonlimiting examples in which a fluid bed reaction is used, the metal oxide catalyst on the oxide support may include (or in some cases may consist essentially of) particles with sizes in the range of about 0.05 mm to about 0.2 mm. In nonlimiting examples in which a moving bed reaction is used, the metal oxide catalyst on the oxide support may include (or in some cases may consist essentially of) particles with sizes in the range of about 0.05 mm to about 0.2 mm.

In some examples, the catalytic conversion of the hot lipid stream to the intermediate composition uses steam as an additional input to the adiabatic reactor, e.g., via piping 212 coupled to a second inlet of adiabatic reactor 220 illustrated in FIG. 2. The steam may inhibit cracking and coke formation. In some examples, the steam is provided in an amount of about 0 wt % to about 50 wt %, and its use is optional. Some examples use substantially only steam and the hot lipid stream as inputs to the adiabatic reactor 220 for reactions which are catalyzed by the metal oxide catalyst on the oxide support. That is, hydrogen may not be separately input to adiabatic reactor 220. Additionally, the steam may not be a reactant in the reactions between the hot lipid stream and the metal oxide catalyst on the oxide support, e.g., may not be a source of hydrogen for such reactions. In some examples, the steam is omitted.

Illustratively, in the nonlimiting example illustrated in FIG. 2, system 200 may include piping 222 coupled to an outlet of adiabatic reactor 220 such that the intermediate composition, which is generated by reaction of the hot lipid stream over the metal oxide catalyst 221 within adiabatic reactor 220, may be flowed out of adiabatic reactor 220. The metal oxide catalyst 221 may be regenerated at any suitable time, and in any suitable manner. For example, in nonlimiting configurations in which the metal oxide catalyst is in a fixed bed, the hot lipid stream inlet may be turned off, and air may be provided to the adiabatic reactor 220 to stimulate a combustion process therein which burns coke from the metal oxide catalyst 221.

In some examples, system 200 may include reservoir 240 which is coupled directly or indirectly to piping 222 and configured to receive the intermediate composition or a portion thereof. The intermediate composition in its entirety, or a portion of the intermediate composition, may be stored in reservoir 240 for use as a fuel without any further catalytic processing of the intermediate composition. Reservoir 240 may be located in a fixed position or may be portable, e.g., may located on a tanker truck or tanker ship to transport the intermediate composition or portion thereof to another location for further processing which is non-catalytic and/or for use as a fuel.

In nonlimiting examples in which the intermediate composition is stored or transported for use as the fuel, reservoir 240 may be coupled directly to piping 222 to collect the intermediate composition for such storage or transport.

In nonlimiting examples in which a portion of the intermediate composition is stored or transported for use as the fuel, reservoir 240 may be indirectly coupled to piping 222 via one or more other components configured to further process the intermediate composition, without any further catalytic processing. Illustratively, as illustrated in FIG. 2, piping 222 may directly or indirectly couple adiabatic reactor 220 to distillation column 230 which is configured to generate a distillation cut of the intermediate composition. Distillation column 230 may be coupled to reservoir 240 via piping 231. The distillation cut may be stored in reservoir 240 and/or may be transported for use directly or indirectly as a fuel.

Figure 3A:
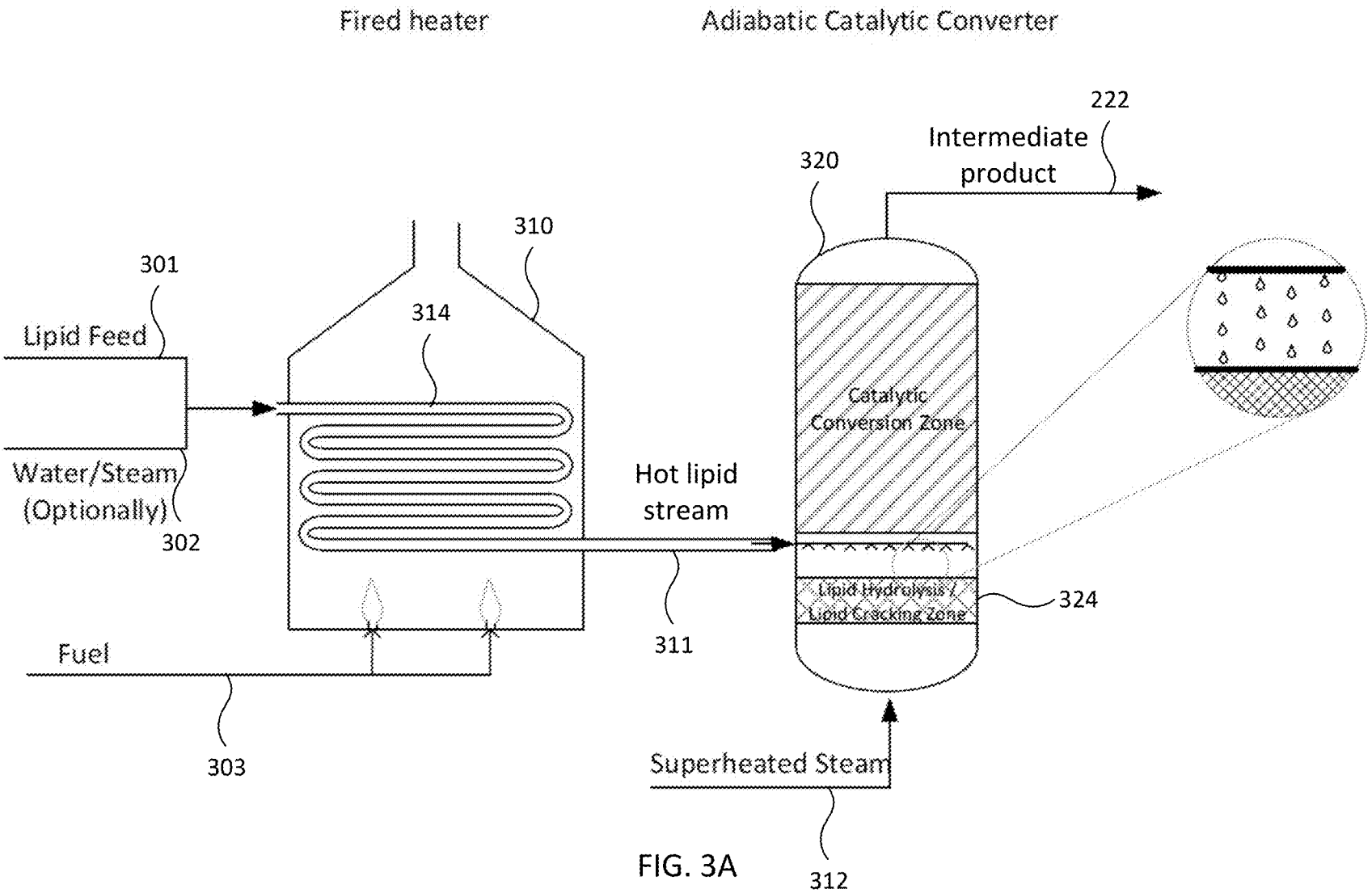
FIG. 3A schematically illustrates example components for use in the system of FIG. 2 for processing renewable lipid feedstocks comprising fatty acid glycerol esters.
Figure 3B:
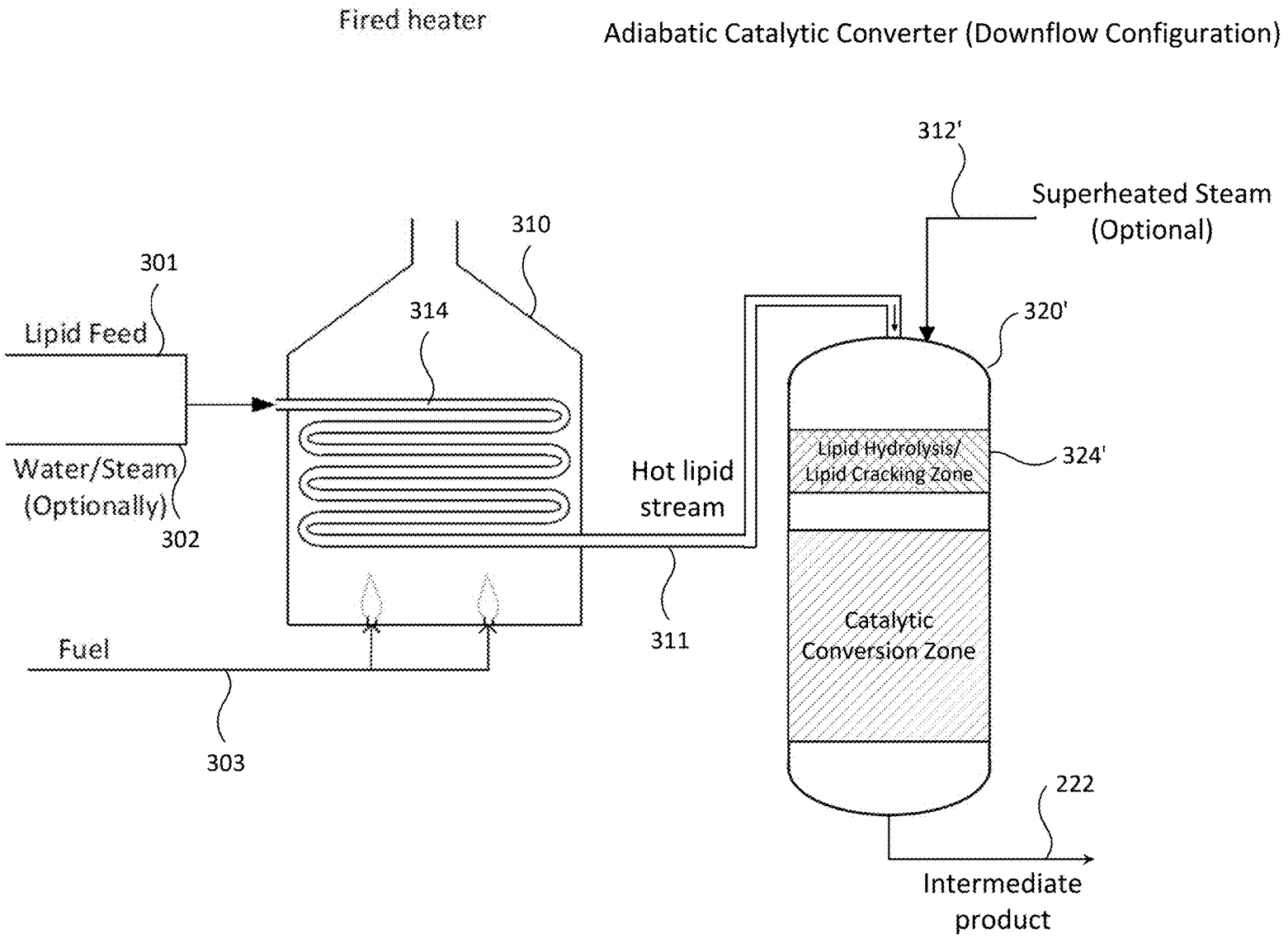
FIG. 3B schematically illustrates an alternate configuration of example components for use in the system of FIG. 2 for processing renewable lipid feedstocks comprising fatty acid glycerol esters (downflow configuration).

FIG. 3A and FIG. 3B schematically illustrates example components for use in the system of FIG. 2 for processing renewable lipid feedstocks comprising fatty acid glycerol esters. More specifically, FIG. 3A illustrates an example heater 310 which may be used as heater 210 described with reference to FIG. 2, and an example adiabatic reactor 320 which may be used as adiabatic reactor 220 described with reference to FIG. 2. In the nonlimiting example illustrated in FIG. 3A, heater 310 includes tube heater 314, which in some examples may be an unbranched single-tube heater, and which may be fired using fuel transported via piping 303. Optionally, the fuel is a product or byproduct of the catalytic conversion performed in reactor 320. The lipid feedstock may be introduced to heater 310 using piping 301. Optionally, water, steam, and/or an inert gas are introduced to heater 310 using piping 302. As a further option, piping 301 and piping 302 merge with one another to mix the lipid feedstock with the water, steam, and/or inert gas before the mixture is introduced to heater 310. In the nonlimiting example illustrated in FIG. 3A, adiabatic reactor 320 includes a fixed catalyst bed 324 upon which the hot lipid stream is distributed and which forms a lipid hydrolysis/lipid cracking zone. The lipid hydrolysis/lipid cracking zone also serves as a trap for solid precipitates such as coke and/or metal salts that may precipitate out during the heating in heater 310. In acting as a trap for such impurities, it helps to protect the remainder of the catalyst bed against plugging. Piping 312 introduces superheated steam into the reactor 320. The steam flows upwards through the fixed catalyst bed, carrying reaction intermediates upward through the reactor 320 to generate the intermediate composition which flows out of an outlet coupled to piping 222 which may be used in a manner such as described with reference to FIG. 2.

In another example, a different reactor configuration as shown in FIG. 3B (downflow configuration) may be used. Similarly as described above, the hot lipid stream is generated by flowing lipid feedstock and optionally water/steam/inert gas through a heater. In this configuration, the hot lipid stream exits the heater and enters adiabatic reactor 320' through piping 311' from the top and flows downward through fixed catalyst bed 324 to form the lipid hydrolysis/lipid cracking zone. The lipid hydrolysis/lipid cracking zone also serves as a trap for solid precipitates such as coke and/or metal salts that may precipitate out during the heating in heater 310. The reaction intermediate further flows downward through reactor 320' to generate the intermediate composition which flows out through the bottom through an outlet coupled to piping 222 which may be used in a manner such as described with reference to FIG. 2. Optionally, superheated steam may be delivered to reactor 320' through inlet 312' from the top to further facilitate the conversion of the hot lipid stream.

In some examples, distillation may be used to separate the intermediate composition exiting the adiabatic reactor into any one or ones of the following components: 1) renewable fuel gas including (and, in some examples, consisting essentially of) C1 and C2 hydrocarbons with a boiling point range of about 0° C. to about 20° C., 2) a renewable liquefied petroleum gas (LPG) including (and, in some examples, consisting essentially of) C3 and C4 hydrocarbons with a boiling point range of about 20° C. to about 150° C., 3) a renewable intermediate transportation fuel including (and, in some examples, consisting essentially of) hydrocarbons in the range of C5 to C20 with a boiling point range of about 150° C. to about 360° C., and 4) a heavy ends product including (and, in some examples, consisting essentially of) hydrocarbons in the range of C21 to C35 with a boiling point range of about 360° C. to about 490° C.

In some examples, such separation may be used to obtain a liquid portion of the intermediate composition having the following characteristics:

(1) naphtha (boiling point of about 20° C. to about 100-150° C.) of greater than 10 wt % and less than about 30 wt % in the intermediate composition;

(2) intermediate transportation fuel (boiling point of about 100-150° C. to about 360° C.) of greater than about 40 wt % and less than about 60 wt % in the intermediate composition; and (3) heavy ends product (boiling point of about 360° C. to about 490° C.) of less than about 30 wt % in the intermediate composition.

In some examples, the liquid portion of the intermediate composition may be further characterized as having greater than 90% of its carbon content being renewable carbon of biological (as opposed to fossil/mineral) origin as measured by standard C14 radiocarbon analysis. In some examples, the liquid portion of the intermediate composition may be further, or alternatively, characterized as having an oxygen content in the range of 1-4 wt %. In some examples, the liquid portion of the intermediate composition can be further, or alternatively, characterized as having an NMR branching index of greater than about 14%, wherein the NMR branching index is defined as the integral of the protons in the methyl region of 0.5 to 0.95 ppm as a percentage of the integral of the entire aliphatic proton resonances region of 0.5 to 2.1 ppm. In some examples, the liquid portion of the intermediate composition may be further, or alternatively, characterized as having about 10 wt % to about 50 wt % of oxygen containing molecules and/or at least about 50 wt % of oxygen-free hydrocarbons.

In some examples, the liquid portion of the intermediate composition can be further, or alternatively, characterized as having more than about 70 wt %, or more than about 80 wt %, of the oxygen in the product being in the form of ketone groups. Additionally, or alternatively, in some examples, the liquid portion of the intermediate composition may be characterized as having at least about 10 wt % of the oxygen in the form of methyl ketones (Me-C(O)—R).

In some examples, the liquid portion of the intermediate composition can be further, or alternatively, characterized as having a total acid number (TAN) of less than 1.

In one nonlimiting example, an intermediate transportation fuel portion of the liquid intermediate composition that is suitable for use in a fuel (e.g., may be used directly as a fuel, or may be incorporated into a fuel blend) without hydroprocessing may be characterized as:

(1) having greater than 90% of its carbon content being renewable carbon of biological (as opposed to fossil/mineral) origin as measured by standard C14 radiocarbon analysis;

(2) having a freezing point of less than about −15° C.;

(3) having less than about 10 wt % of its content comprising acyclic isoalkanes; and (4) having greater than about 15 wt %, (e.g., greater than about 20 wt %, or greater than about 30 wt %) of its content being saturated hydrocarbons with one or two rings (i.e., cycloalkanes).

In some examples, the intermediate transportation fuel portion can be further, or alternatively, characterized as a composition in which the fraction of saturated hydrocarbons with one or two rings is at least twice the fraction of saturated acyclic hydrocarbons (i.e., traditional isoalkanes). In some examples, the intermediate transportation fuel portion can be further characterized as a composition in which the fraction of saturated hydrocarbons with one or two rings is larger than the fraction of saturated acyclic hydrocarbons (i.e., traditional isoalkanes).

As noted above, transportation fuels have to meet certain specifications. The cold flow properties may be particularly challenging when making renewable fuels from lipid feedstock. For example, lipids may include linear molecular components which, in previously known methods, tend to hydrotreat to predominantly linear products, which may have relatively high pour, cloud, and freeze points. Consequently, conventional renewable fuels produced using previously known methods may need extensive isomerization/dewaxing to meet the cold flow property specification. In comparison, the present intermediate compositions, made using the present systems and methods, surprisingly may be used in a fuel without the need for isomerization, dewaxing, or other hydroprocessing. Alternatively, the intermediate composition may be hydroprocessed to form a transportation fuel.

Additional examples will be elucidated below with reference to example data.

Working Examples

The following examples are intended to be purely illustrative, and not limiting of the present subject matter.

Figure 4:
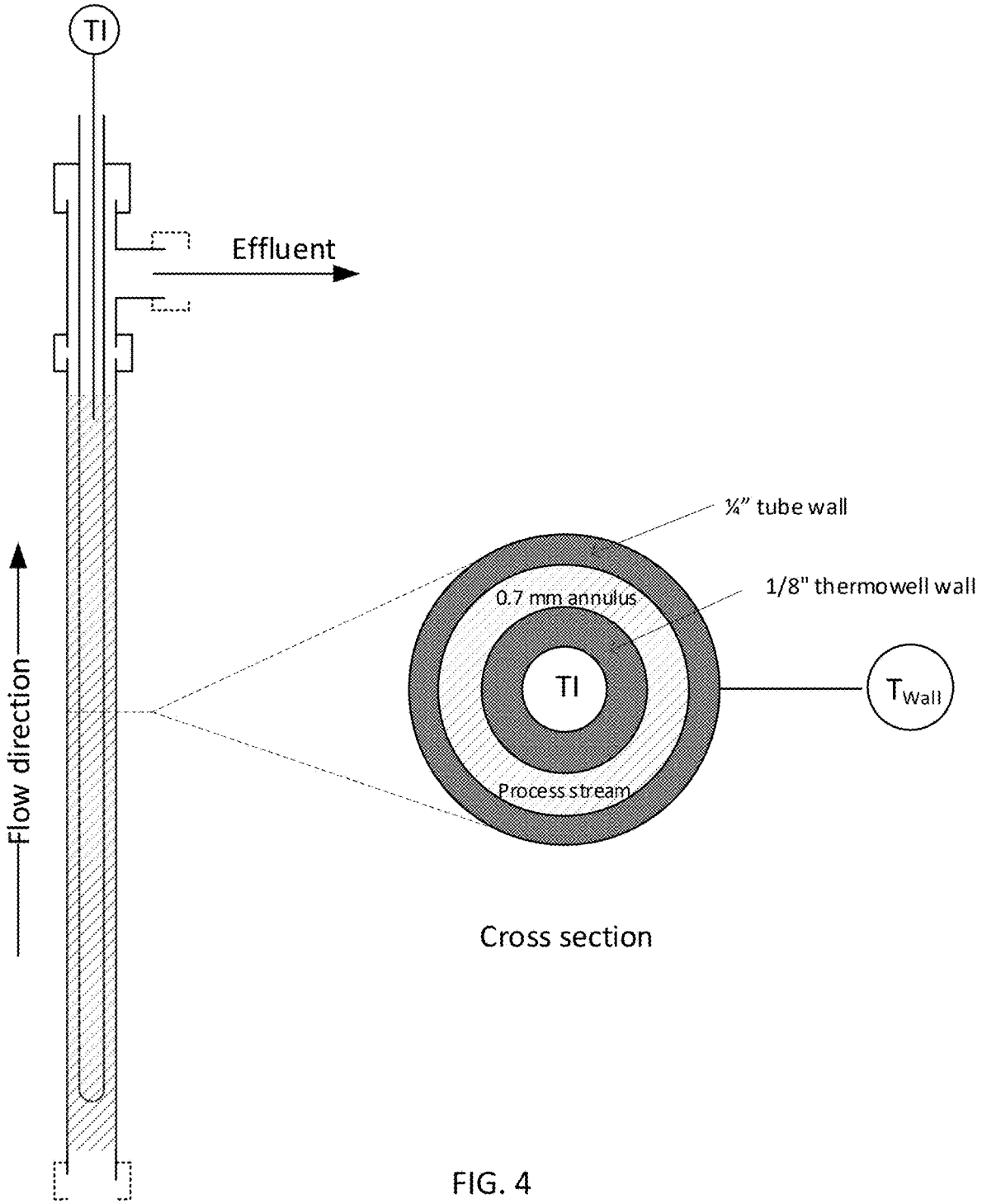
FIG. 4 illustrates the layout of the heater unit used in the Working Examples.

The impact of heat flux and relatively fast heating on lipid feedstocks was studied in a ¼" unbranched single-tube heater unit, in which the outer wall was the heat transfer surface and its wall temperature was controlled by external heating. The temperature of the flowing medium was measured by a central ⅛" multipoint thermocouple placed in the center of the ¼" heater tube and the heated process stream was passed through the narrow annulus between the heater wall and the thermocouple. FIG. 4 illustrates the layout of the heater unit. In FIG. 4, TI represents the temperature in the center of the tube at multiple points along the central axis of the hater, and $T_{wall}$ is the temperature of the outside of the heater wall.

The extent of cracking and isomerization was monitored by measuring the amount of terminal olefins (R—CH═$CH_2$, alpha olefins, 1-olefins, alfa olefins) in the total olefins using nuclear magnetic resonance (NMR) spectroscopy. The present inventor has discovered that this is a reliable indicator of the extent of thermal cracking of the lipid feedstock in the heater. Naturally occurring lipids do not contain terminal olefins, and alpha olefins only form in measurable amounts when the lipids are heated to temperatures at which they undergo thermal cracking reactions. In the Working Examples, alpha olefins (R—CH═$CH_2$) exhibited resonances corresponding to two protons in the 4.8-5.2 ppm range and one proton in the 5.6-5.9 ppm range. In comparison, internal olefins (R—CH═CH—R) such as are typical in naturally occurring olefins in lipids have resonances corresponding to two protons in the 5.2-5.6 ppm range.

Figure 5:
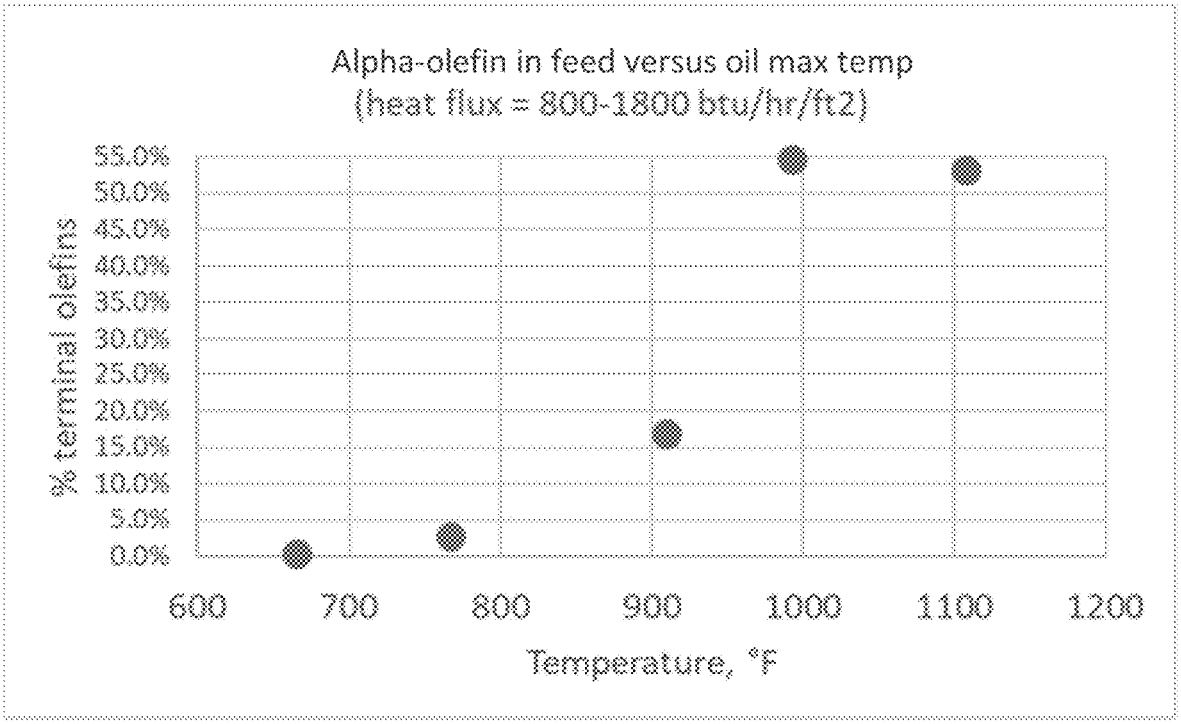
FIG. 5 is a plot illustrating the impact of temperature on terminal olefin content when heating choice white grease (CWG) at moderately low heat flux in the range of 800-1800 BTU/ft$^2$/hour.

FIG. 5 is a plot illustrating the impact of temperature on terminal olefin content when heating choice white grease (CWG) at moderately low heat flux in the range of 800-1800 BTU/$ft^2$/hour. For comparison, lipid heaters in commercial operations typically operate with heat fluxes in the range of about 2000-4000 BTU/$ft^2$/hour. As may be understood from FIG. 5, below about 700° F. the lipid feedstock can be heated with little or no cracking being observed. As the temperature increases above about 750° F., the product contains increasing concentrations of alpha-olefins, until the alpha-olefin content reaches a plateau-level of about 45-55% as temperature approaches 1000-1100° F.

Additional tests were performed during which the extent of cracking of a lipid feedstock was determined as a function of heat flux. These tests were conducted by setting the wall temperature to a setpoint and then adjusting the lipid feedstock's rate of flow until the feedstock passing through the heater reached 900° F.±5° F. This was repeated with a series of wall temperatures in the range of 920° F. to 1100° F. In each test, the feedstock reached the same temperature regardless of the wall temperature and heat flux.

Figure 6:
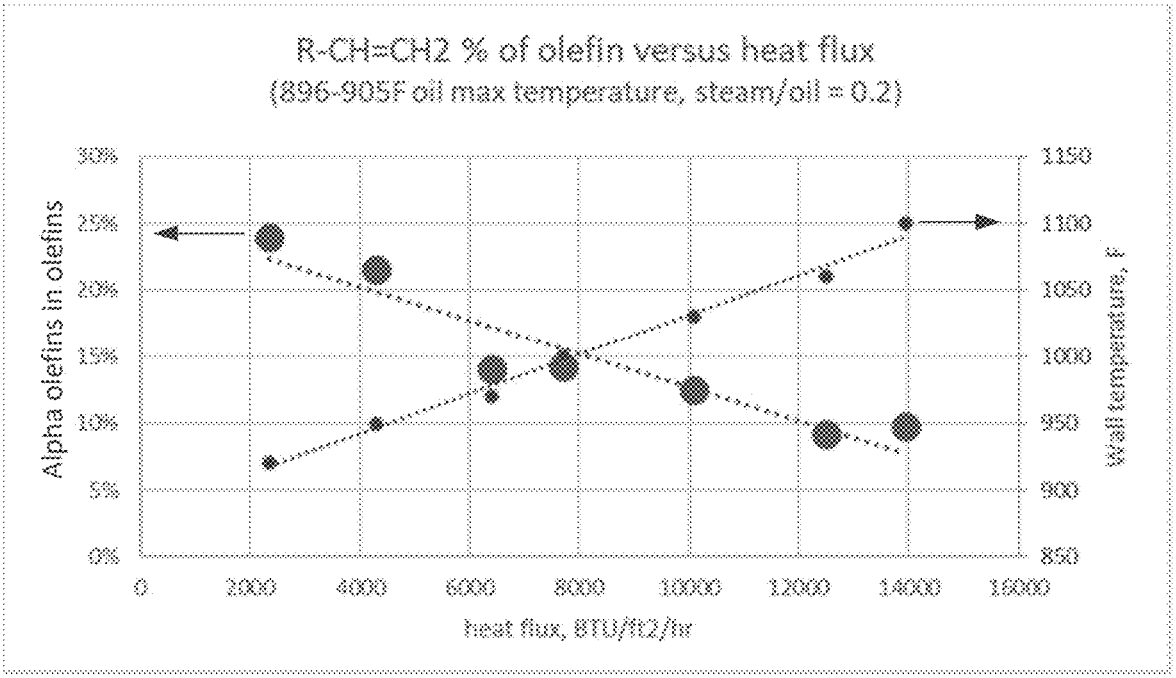
FIG. 6 is a plot showing how increased heat flux generated fewer alpha olefins and thus lower cracking in soybean oil (SBO).

FIG. 6 is a plot showing how increased heat flux generated fewer alpha olefins and thus lower cracking in soybean oil (SBO). In the tests depicted, SBO was heated from about 300-350° F. to 900° F. in the presence of about 20 wt % steam. In FIG. 6, the larger circles show the alpha olefin content in the product (hot lipid stream) as a function of heat flux, and the smaller circles show the wall temperature at which the heat flux was achieved. As may be understood from FIG. 6, increasing the heat flux from 2000 BTU/ft$^2$/hour to 14000 BTU/ft$^2$/hour decreased the amount of alpha olefins formed from about 25% to about 10%, with heat fluxes above about 6000 BTU/ft$^2$/hour causing a significant and surprising reduction in the amount of alpha olefins produced as compared to heat fluxes below about 4000 BTU/ft$^2$/hour. It is expected that a further increase in heat flux will further reduce the cracking rate, but the laboratory unit in which the tests were performed had a maximum attainable heat flux of 14000 BTU/ft$^2$/hour.

Figure 7:
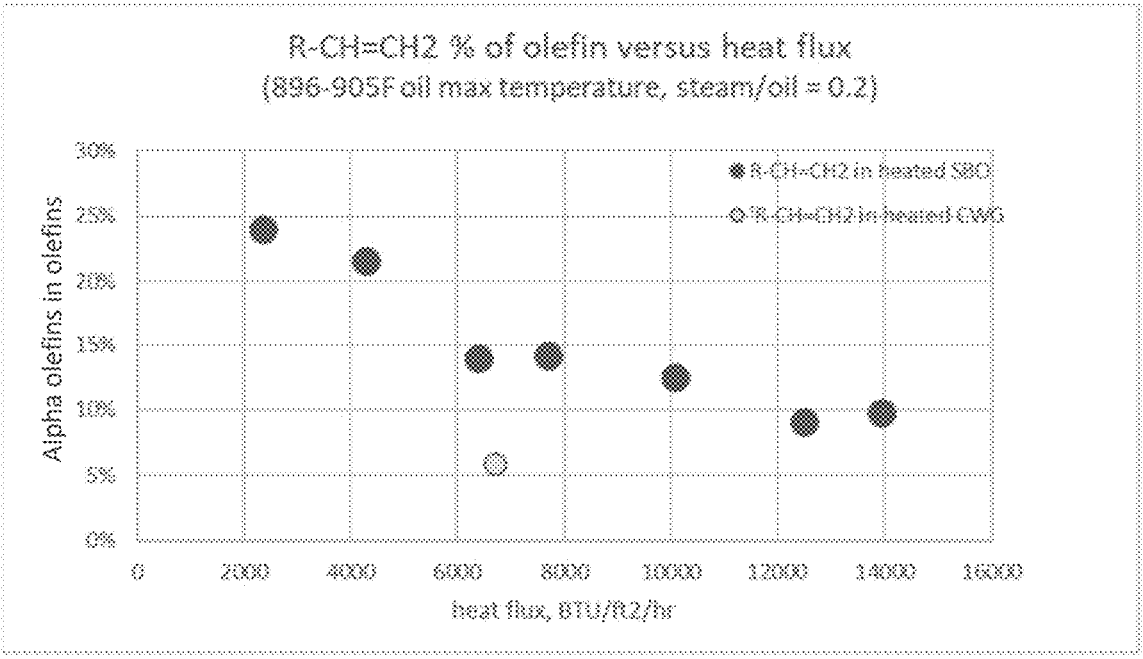
FIG. 7 is a plot comparing the amount of alpha olefin formation in CWG with alpha olefin formation in SBO at different heat fluxes.

It should be noted that while the trend towards increased alpha olefin content with increased heater residence time is general, the absolute effect of heating is also affected by the chemical composition of the particular lipid feedstock being heated. For example, FIG. 7 is a plot comparing the amount of alpha olefin formation in CWG with alpha olefin formation in SBO at different heat fluxes. As may be understood from FIG. 7, SBO shows a higher tendency to form alpha olefins upon heating than CWG. FIG. 7 depicts the same relationship between heat flux and alpha olefin amount as FIG. 6, with an added point for CWG. Because SBO is more unsaturated than CWG, the observation shown in FIG. 7 is consistent with higher thermal cracking rates being observed for more unsaturated lipid feedstocks.

Without wishing to be bound by any theory, the present inventor believes that increasing heat fluxes reduce the amount of cracking in a lipid feedstock because a higher heat flux reduces the lipid feedstock's residence time in the heater to achieve the same temperature as does a lower heat flux. Indeed, as recognized by the present inventor, controlling the lipid feedstock's residence time in the heater is useful for controlling cracking and fouling, and a useful way of controlling the residence time is to heat the lipid feedstock using an unbranched single-tube heater in which the residence time for all parts of the process stream (lipid feedstock being heated) is essentially the same. This is different from a more traditional tube-and-shell exchanger which can have eddies and other hold-ups that can extend the feedstock's residence time in the heater.

To further demonstrate the usefulness of unbranched single-tube heaters, a series of tests was performed in a small pilot designed to model a traditional delayed Coker feed heater, which is conventionally used to heat an oil far beyond the temperature at which it forms coke but with residence time in the heater too short for the coke to have time to form; conventionally, the heated oil is then collected in a coke drum where the coke is allowed to form.

The heater in these tests consisted of a 20 foot long ¼" tube in serpentine shape placed in an electrically heated oven, similarly as shown in FIG. 3A and FIG. 3B. CWG, which is notorious for fouling heat exchangers, was used as the lipid feedstock. In a base case, CWG (trace 801 in FIG. 8) was fed at a rate of 2.4 kg/hour together with 0.6 kg/hour steam and heated to an outlet temperature of 932° F. The test was repeated with half the amount of steam (trace 802 in FIG. 8), and repeated again with nitrogen replacing the omitted steam at a similar linear velocity (trace 803 in FIG. 8). Additionally, a benchmark test was performed using a traditional Coker feed (fossil-based vacuum residual oil) as used in a commercially delayed Coker (trace 804 in FIG. 8). In each test, the unit was operated for 12 hours non-stop, after which the tube was cut up and the deposits determined by weighing the individual pieces of tube. Note that test conditions were chosen to accelerate fouling. More specifically, the actual heat flux test conditions is estimated to be in the range of 2100-2400 BTU/ft$^2$/hour, which is lower than what is believed to be the optimal range of about 6000 BTU/ft$^2$/hour or higher but was selected to give a higher rate of fouling in order to facilitate generating comparative data for the unbranched single-tube layout on a practicable timeframe.

Figure 8:
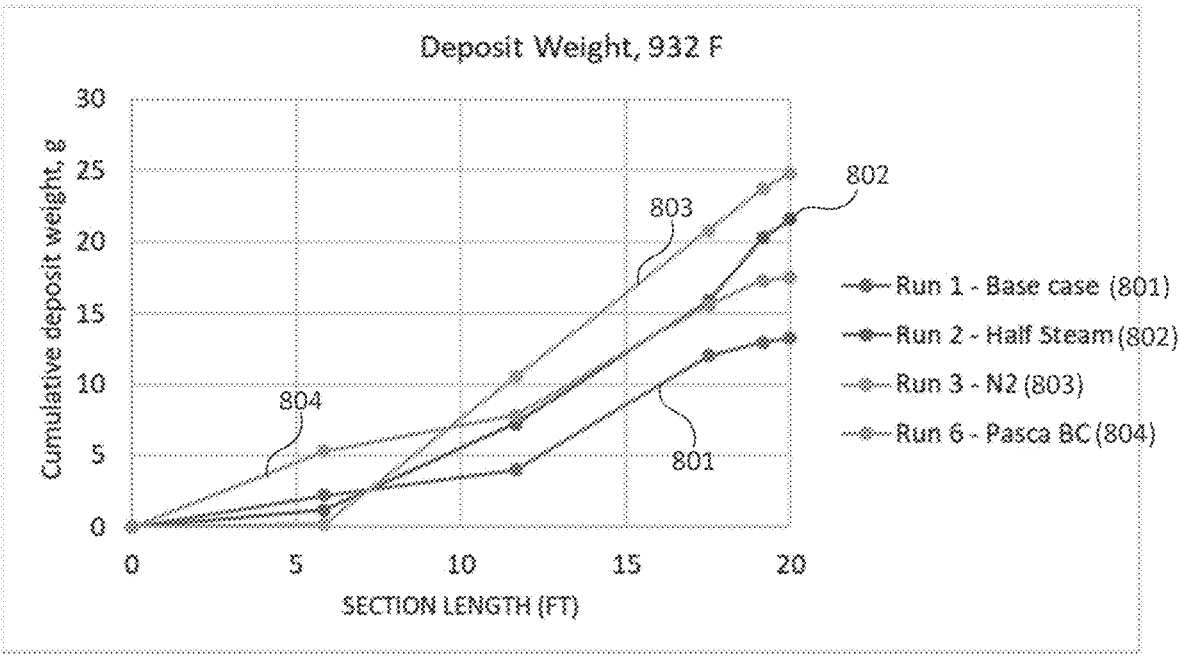
FIG. 8 is a plot showing heater fouling for CWG at various conditions as compared to a conventional delayed Coker feed.

FIG. 8 is a plot showing heater fouling for CWG at various conditions (801, 802, 803) as compared to a conventional delayed Coker feed (804). As may be understood from FIG. 8, the fouling rate for CWG under these conditions (801, 802, 803) was similar to the fouling rate for the conventional delayed Coker feed (804). The base case (801) was better than the benchmark (804), whereas the "half steam" (802, which used 300 g steam co-fed with 2400 g/hour CWG) had almost the same fouling rate as the benchmark. Nitrogen as co-feed (803) was inferior to steam (801, 802) for suppressing heater fouling.

From the foregoing, it may be understood that heating lipid feedstocks at a sufficiently high heat flux, to a temperature in the range of about 450° C. to about 550° C., using a heat flux greater than about 6000 BTU/ft$^2$/hour, may be used to generate a hot lipid stream substantially without forming coke.

Additional Comments

While various illustrative embodiments of the invention are described above, it will be apparent to one skilled in the art that various changes and modifications can be made therein without departing from the invention. The appended claims are intended to cover all such changes and modifications that fall within the true spirit and scope of the invention.

What is claimed is:

1. A method for processing a renewable lipid feedstock comprising fatty acid glycerol esters, the method comprising:

heating the renewable lipid feedstock, in the absence of a catalyst, to a temperature in the range of about 450° C. to about 550° C., using a heat flux greater than about 6000 BTU/ft$^2$/hour to generate a hot lipid stream substantially without forming coke, wherein less than 40% of the hot lipid stream is lighter than T10 of the lipid feedstock.

2. The method of claim 1, wherein the heat flux is in the range of about 6000-25000 BTU/ft$^2$/hr.

3. The method of claim 1, wherein less than 15% of olefins in the hot lipid stream are alpha olefins.

4. The method of claim 1, wherein the heating is performed in the presence of steam or an inert gas.

5. The method of claim 1, wherein the heating is performed in an unbranched single-tube heater.

6. A method for processing a renewable lipid feedstock comprising fatty acid glycerol esters, the method comprising:

heating the renewable lipid feedstock, in the absence of a catalyst, to a temperature in the range of about 450° C. to about 550° C., using a heat flux greater than about 6000 BTU/ft$^2$/hour to generate a hot lipid stream substantially without forming coke, wherein the renewable lipid feedstock comprises at least about 5 ppm chlorine as an impurity, or at least about 10 ppm phosphorous as an impurity.

7. The method of claim 6, wherein the renewable lipid feedstock comprises choice white grease (CWG) or palm oil mill effluent (POME).

8. The method of claim 1, further comprising, in an adiabatic reactor, converting the hot lipid stream to an intermediate composition in the presence of a catalyst.

9. The method of claim 8, further comprising hydroprocessing the intermediate composition to form a final product, wherein the final product comprises a transportation fuel.

10. The method of claim 9, further comprising fractionating the intermediate composition to obtain the transportation fuel.

11. The method of claim 8, wherein the catalyst comprises a metal oxide catalyst on an oxide support.

12. A system for processing a renewable lipid feedstock comprising fatty acid glycerol esters, the system comprising:

a heater to generate a hot lipid stream, substantially without forming coke, by heating the renewable lipid feedstock, in the absence of a catalyst, to a temperature in the range of about 450° C. to about 550° C., using a heat flux greater than about 6000 BTU/ft$^2$/hour, wherein less than 40% of the hot lipid stream is lighter than T10 of the lipid feedstock.

13. The system of claim 12, wherein the heat flux is in the range of about 6000-25000 BTU/ft$^2$/hr.

14. The system of claim 12, wherein less than 15% of olefins in the hot lipid stream are alpha olefins.

15. The system of claim 12, wherein the heating is performed in the presence of steam or an inert gas.

16. The system of claim 12, wherein the heater comprises an unbranched single-tube heater.

17. A system for processing a renewable lipid feedstock comprising fatty acid glycerol esters, the system comprising:

a heater to generate a hot lipid stream, substantially without forming coke, by heating the renewable lipid feedstock, in the absence of a catalyst, to a temperature in the range of about 450° C. to about 550° C., using a heat flux greater than about 6000 BTU/ft$^2$/hour, wherein the renewable lipid feedstock comprises at least about 5 ppm chlorine as an impurity or at least about 10 ppm phosphorous as an impurity.

18. The system of claim 12, wherein the renewable lipid feedstock comprises choice white grease (CWG) or palm oil mill effluent (POME).

19. The system of claim 17, further comprising an adiabatic reactor to convert the hot lipid stream to an intermediate composition in the presence of a catalyst.

20. The system of claim 19, further comprising a hydroprocessing reactor to hydroprocess the intermediate composition to form a final product, wherein the final product comprises a transportation fuel.

21. The system of claim 20, further comprising a distillation column to fractionate the intermediate composition to obtain a transportation fuel.

22. The system of claim 19, wherein the catalyst comprises a metal oxide catalyst on an oxide support.

* * * * *